United States Patent [19]

Lamprey

[11] 4,162,718

[45] Jul. 31, 1979

[54] HYDRAULIC ELEVATOR

[76] Inventor: Donald F. Lamprey, 114 Glenwood Dr., Liverpool, N.Y. 13088

[21] Appl. No.: 824,295

[22] Filed: Aug. 15, 1977

[51] Int. Cl.[2] ..... B66B 5/02

[52] U.S. Cl. ..... 187/29 A

[58] Field of Search ..... 187/29; 318/471, 473

[56] References Cited

U.S. PATENT DOCUMENTS

| | | | |
|---|---|---|---|
| 3,290,576 | 12/1966 | Jensen et a. | 318/471 |
| 3,398,690 | 8/1968 | Deaton | 318/471 X |
| 3,530,958 | 9/1970 | Brannon et al. | 187/29 A |
| 3,636,426 | 1/1972 | Buiting | 318/471 |

*Primary Examiner*—J. V. Truhe
*Assistant Examiner*—W. E. Duncanson, Jr.
*Attorney, Agent, or Firm*—Bruns & Jenney

[57] ABSTRACT

Apparatus for use in conjunction with a hydraulically operated lift for detecting an overheated condition in the lift equipment and, in response thereto, automatically carrying out measures to prevent the equipment from being damaged.

4 Claims, 2 Drawing Figures

HYDRAULIC ELEVATOR

BACKGROUND OF THE INVENTION

This invention relates to a hydraulically operated lift and, in particular, to means for preventing the lift equipment from being damaged due to overheating.

More specifically, this invention relates to a protective system for use in a hydraulic elevator.

As is well known in the art, hydraulically operated lifts and elevators are dependable pieces of apparatus that are able to efficiently raise heavy loads to substantial heights. For this and other reasons hydraulic elevators are widely used in many types of buildings. In the typical installation, the operation of the elevator is automatically controlled by means of a computer. In practice the computer is programmed to respond to normal station or floor calls as well as carry out ancillary duty functions directed toward maintaining a smooth and effective operation of the system. Such ancillary functions may include, but are not limited to, maintaining the hydraulic fluid at a constant temperature, returning the elevator automatically to a predetermined home station, such as the lobby of the building, when not in use and correctively relevelling the elevator as required.

Because this type of equipment is fully automatic, however, there exists the very real possibility that a defect or malfunction might go undetected for a relatively long period of time. In the case of certain automatic corrective functions, such as the above noted relevelling function, the equipment can in fact hide or mask a problem to such an extent that a potentially dangerous situation is created. Generally a system malfunction will cause the equipment to run excessively which, in turn, drives the temperature of the hydraulic fluid past its critical level. When this occurs, extensive equipment damage ensues and eventually a fire will result.

SUMMARY OF THE INVENTION

It is therefore an object of the present invention to improve the safety of hydraulic lifts and, in particular, hydraulic elevators.

A further object of the present invention is to prevent overheating of the hydraulic fluid employed in a hydraulically operated lift or elevator.

A still further object of the present invention is to reduce the danger of fire in an automatically controlled hydraulic elevator.

Another object of the present invention is to protect the component parts of a hydraulic elevator from heat or fire damage.

These and other objects of the present invention are attained by means of a hydraulic lift having a platform arranged to be raised and lowered by a hydraulic ram and further including a reservoir containing a quantity of hydraulic fluid, a hydraulic control system for regulating the movement of fluid between the reservoir and the ram, a motor driven pump operatively associated with the control system for delivering fluid under pressure from the reservoir into the ram, and means for inactivating the pump motor when a high temperature condition is detected in the hydraulic fluid. Further apparatus is also provided to immediately shut down the hydraulic heater and to return the lift to a relatively low, and thus safer, elevation when a high temperature condition is detected.

BRIEF DESCRIPTION OF THE DRAWINGS

For a better understanding of the invention as well as other objects and further features thereof, reference is had to the following detailed description of the invention to read in connection with the accompanying drawings, wherein.

DESCRIPTION OF THE PREFERRED EMBODIMENT

Figure 1:
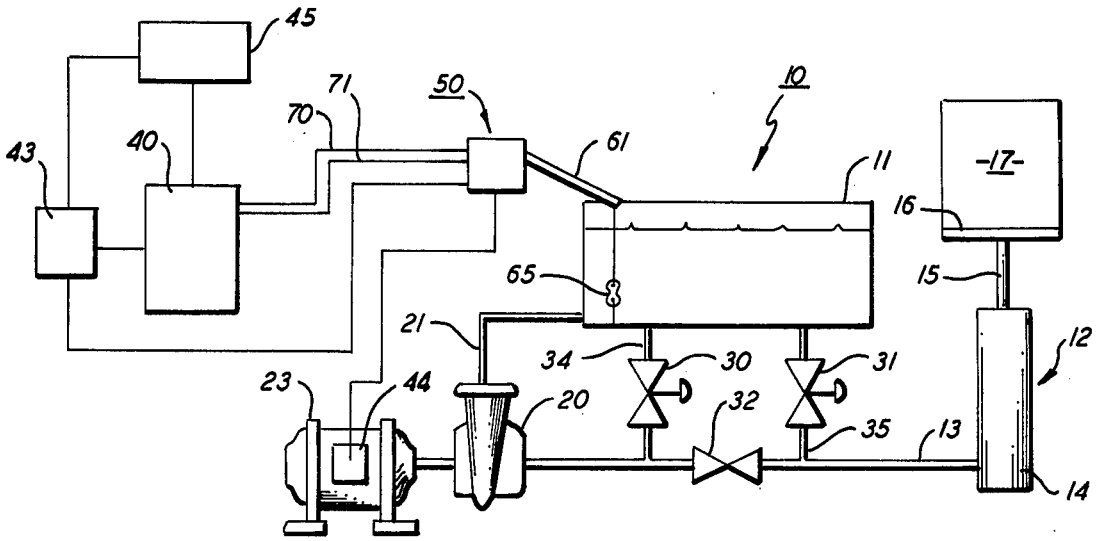
FIG. 1 is a schematic representation of a hydraulic elevator and its associated control system embodying the teachings of the present invention.

FIG. 1 depicts in schematic form a hydraulic elevator installation generally referenced 10. Although the present invention will be described in reference to this specific embodiment, it should be evident to one skilled in the art that the invention is not so limited and it may be equally well employed in conjunction with a suitable hydraulic lift that is exposed to thermal damage due to excessive overheating of the hydraulic fluid used therein. As will become apparent from the description below, the apparatus of the present invention is capable of detecting an overheated condition in the hydraulic fluid contained in the system and taking immediate action to shut the equipment down while, at the same time, providing for the safety and comfort of any passengers who might be using the equipment at the time.

As is conventional in this type of installation, a quantity of hydraulic fluid is stored within a central reservoir 11 of predetermined capacity. The fluid in the reservior is directed into and out of a hydraulic ram 12 by means of main hydraulic line 13. The ram includes a cylinder 14 which contains a piston (not shown) that is arranged to drive piston arm 15 up and down as fluid is fed into or out of the cylinder. As illustrated in FIG. 1, the piston arm is operatively attached to the platform 16 of elevator cab 17 whereby the cab moves in direct response to motion translated thereto by arm 15.

A fluid pump 20, of any suitable design, is placed in fluid flow communication with the reservoir by means of the pump inlet line 21. Under the influence of the pump, fluid is drawn from the reservoir and delivered under relatively high pressure discharged into the main hydraulic line 13. In practice the pump is mechanically coupled via a shaft to an electrical motor 23. In this arrangement the on-off function of the pump is governed by the motor activity.

In the present system, the movement of the hydraulic fluid between the reservoir and the ram is controlled by means of two electrically operated control valves 30,31 and a one way check valve 32. Each of the electrically operated control valves are operatively positioned within two parallel feeder lines 34,35 running between the bottom wall of the reservoir and the main hydraulic line 13. Valve 30 controls the upward movement of the elevator cab while valve 31 controls its downward movement. The one way check valve 32 is located in the main hydraulic line 13 about midway between the point of entry of the two feeder lines. The check valve is adapted to freely pass fluid moving along line 13 in a direction from the pump toward the ram while preventing fluid moving in the opposite direction from passing therethrough.

As noted, the operation of the elevator is controlled by means of a computer 40. As is well known in the art, the computer is arranged to accept both manual and automatically generated input signals, analyze the data, and, in response thereto, instruct the hydraulic system to carry out the required duty function. If the duty function requires that the cab be raised, the computer will immediately close starter 43 which permits current to flow from the power supply 45 to the windings of the motor via a quick acting mechanism 50 and junction box 44. This, in turn, causes the pump to draw fluid from the reservoir and deliver it under pressure into the ram driving arm 15, and thus cab 17, in an upward direction. Although not shown, up control valve 30 is also electrically connected to the computer and its relative position adjusted automatically in accordance with the programmed activity by the logic system. The control valve serves to regulate the upward velocity of the cab by controlling the rate at which hydraulic fluid is pumped into the ram. By holding the control valve fully closed, maximum upward velocity of the cab is attained. Moving the valve toward an open position diverts some or all of the pump discharge back into the reservior thereby causing the motion of the cab to be slowed or stopped depending upon the relative setting of the valve.

The downward motion of the cab is simply regulated by permitting the weight of the cab to force fluid out of the ram cylinder. During a down duty cycle, the computer opens the starter, thus inactivating the hydraulic pump, and electrically adjusts the setting of the down control valve 31 to permit fluid driven out of the cylinder to enter the reservoir at a controlled rate.

The computer logic is also programmed to relevel the cab automatically in the event the cab platform 16 becomes misaligned with the floor of the duty station at which the cab is parked. This condition is generally produced by the cab settling when parked in one position for any extended period of time. Remote sensors, such as an electric eye device or the like, are positioned to detect any misalignment and instruct the computer of this undesirable occurrence. The computer then starts the pump as explained above and adjusts control valve 30 to ease the cab upwardly into proper alignment with the duty station. The relevelling cycle, because it is fully automatic, poses certain dangers to the equipment. This is particularly true where, because of some malfunction or the like, the system becomes incapable of supporting the cab at one level for any appreciable period of time. Under these conditions, the system is called upon to carry out the relevelling function at relatively short intervals thus keeping the hydraulic fluid in an almost constant state of agitation. If this situation goes unnoticed for any period of time, the hydraulic fluid will become dangerously overheated and eventually a fire will result.

Figure 2:
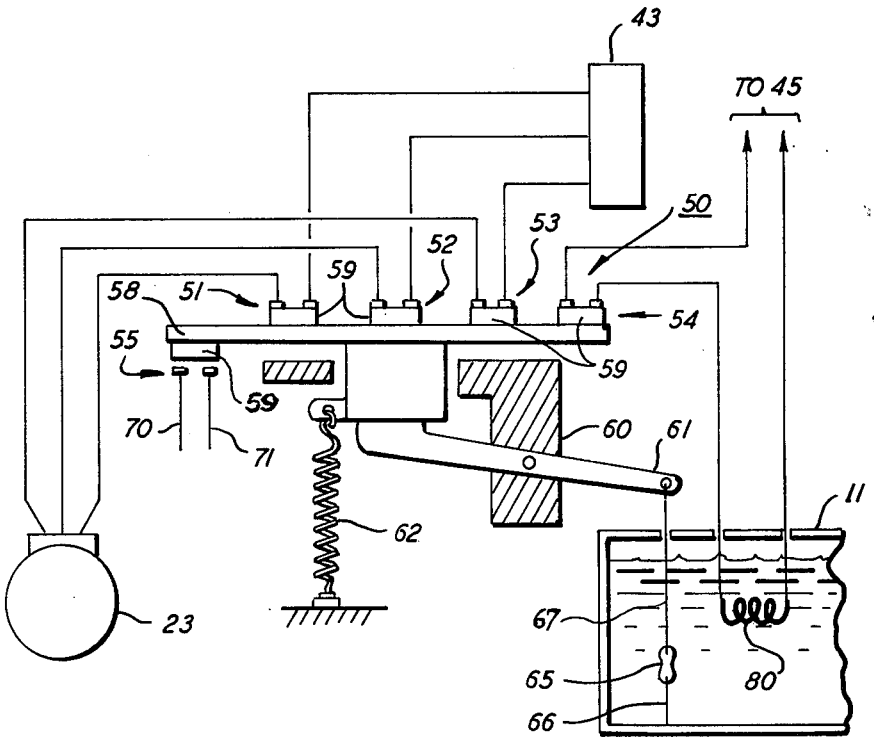
FIG. 2 is an enlarged view of a quick acting mechanical device for inactivating the pump motor of the hydraulic elevator shown in FIG. 1.

In the present apparatus a quick acting mechanism 50 is provided that will respond instantaneously to an overheated hydraulic fluid condition to protect the lift equipment and to provide for the safety and comfort of any passengers who might be using the lift at the time. As best seen in FIG. 2, the quick acting mechanism includes a switch plate 58 that is arranged to open and close a series of contacts 51–55. The switch plate is slidably supported in a stationary member 60 so that conductive bars 59, which are strategically mounted upon the plate, can be moved into opening and closing contact with the contacts 51–55. In assembly, the switch plate is normally supported in a raised position as shown by means of a lever arm 61 whereby contacts 51–54 are normally closed and contact 55 is normally opened.

Again referring to FIG. 2, the lever arm is held in the normal position against the biasing force of spring 62 by means of a fusible link 63 acting between rods 66 and 67. The fusible link is immersed within the hydraulic fluid contained within reservoir 11 and is located close to the bottom of the reservoir by rod 66 which is anchored to the bottom wall thereof. The second rod 67 is secured to the opposite side of the link and extends upwardly beyond the level of the fluid to engage the free end of the lever arm 61.

The fusible link is fabricated of a material that will sever the connection between the rods when the temperature of the fluid in the reservoir approaches a dangerously high level, that is, a level somewhat below the critical flash point of the fluid. By severing the connection, the holding action of the lever arm against the switch plate is removed and the plate is rapidly pulled down by the spring 62. As a result, normally closed contacts 51–54 are now opened and normally opened contact 55 is closed.

Contacts 51–53 are electrically positioned between the motor starter 43 and the three phase winding of motor 23. During normal operation, the contacts are closed thereby permitting cycling of the motor, and thus the hydraulic pump, by opening and closing the starter 43. Upon detecting an overheated condition in the hydraulic fluid, however, the motor circuit between the starter and the motor is broken thereby preventing further agitation of the hydraulic fluid by the pump. It should be noted that by breaking the electrical connection to the motor on the motor side of the starter, continuous operation of the pump is avoided in case the starter becomes jammed or locked in a closed position. Furthermore, in this arrangement, power from the main supply to the computer will not be interrupted when the pump is shut down whereby the computer will be available to carry out certain down duty cycles after the pump is shut down.

As is conventional in most hydraulically operated lift systems, a heater 80 is herein provided to maintain the temperature, and thus the viscosity of the hydraulic fluid at a constant temperature. The heater is immersed within the fluid contained in reservoir 11 and is connected to power supply 45 through normally closed contacts 54. In case of an overheat shut down, contacts 54 are immediately opened to prevent further operation of the heater. The possibility of the heater driving the already overheated fluid beyond its critical point is thereby avoided. Similarly, in the event that the heater itself malfunctions and causes high fluid temperatures in the reservoir, the fusible link will separate and the heater will be automatically shut down. The fifth contact operatively associated with the switch plate 58 is normally opened contact 55. As best seen in FIG. 1, the contacts are electrically connected to computer logic via electrical lines 70,71. In practice, the contact closes a circuit in the logic which automatically instructs the control valve 31 to bring the elevator cab to a lower duty station, such as the ground floor or the like, in the event the elevator is at a higher elevation, or between stations, when the quick acting mechanism 50 is triggered. Accordingly, any passengers who may be in transit are safely returned to the home station. As pointed out above, this operation can be performed by the present apparatus without the need of the pump as long as the computer has power provided thereto.

While this invention has been disclosed with reference to the structure disclosed herein, it is not confined to the details as set forth and this application is intended to cover any modifications or changes that come within the scope of the following claims.

I claim:

1. In a hydraulically operated lift of the type having a motor driven pump for drawing fluid from a reservoir and delivering the fluid under pressure to a ram adapted to raise and lower the lift, valve means for directing fluid between the reservoir and the ram, computer means for controlling the operation of the pump motor and the valve means to raise and lower the lift, the improvement comprising switch means having motor contacts electrically interposed between a starter and the pump motor, said switch means being movable between a first operative position in which the motor contacts are closed to provide power to said motor and a second operable position in which said motor contacts are opened to inactivate said motor, biasing means for urging the switch means toward the second operable position, and thermal sensitive means in heat transfer relation with the fluid contained in the reservoir for physically holding the switch in said first operative position when the temperature of the fluid is below a predetermined level and to immediately release the switch means when the fluid temperature reaches said predetermined level whereby the pump motor is immediately inactivated.

2. The improvement of claim 1 further including heater means being immersed in the fluid contained within the reservoir and having heater contacts for connecting the heater to a source of power, said heater contacts also being operatively connected to the switch means to open said contacts and thus inactivate the heater when the switch means is moved to the second operable position.

3. The improvement of claim 2 which further includes circuit means associated with the computer logic for instructing the computer to lower said lift to a predetermined duty station, said circuit means having normally opened contacts operatively associated with the switch means which are closed to actuate said circuit means when said switch is moved to a second operative position.

4. The improvement of claim 1 wherein said thermal sensitive means is a fusible link that is immersed within the fluid contained in the reservoir, the link being formed of a material that will part at or about the predetermined temperature.

* * * * *